United States Patent [19]

Bedwell

[11] Patent Number: 4,755,254

[45] Date of Patent: Jul. 5, 1988

[54] ROLL PAPER AND TAPE DISPENSING EQUIPMENT

[75] Inventor: Hubert A. Bedwell, Sycamore Township, Hamilton County, Ohio

[73] Assignee: Fibre Glass-Evercoat Company, Inc., Cincinnati, Ohio

[21] Appl. No.: 20,452

[22] Filed: Mar. 2, 1987

[51] Int. Cl.[4] ..... B31F 5/06; B32B 31/18

[52] U.S. Cl. ..... 156/554; 156/516; 156/576; 225/24; 225/34; 225/77

[58] Field of Search ..... 156/554, 516, 574, 576; 225/24, 34, 77

[56] References Cited

U.S. PATENT DOCUMENTS

| | | | |
|---|---|---|---|
| 2,012,014 | 8/1935 | McCarthy | 156/554 |
| 2,510,131 | 6/1950 | Morin | 156/576 |
| 3,553,060 | 1/1971 | Waltz | 156/554 |
| 4,425,182 | 1/1984 | Jones et al. | 156/554 |
| 4,470,870 | 9/1984 | Driscoll et al. | 156/511 |
| 4,572,761 | 2/1986 | Phillips | 156/554 |

*Primary Examiner*—Jerome Massie, IV

*Attorney, Agent, or Firm*—James W. Pearce; Roy F. Schaeperklaus

[57] ABSTRACT

A stand for supporting a roll paper sheet and a roll of tape having an adhesive coating on one face thereof. The stand includes four upright leg members. Opposed roll supports are carried by opposed ones of the leg members. A tape support is carried by another of the leg members. Tape from the roll of tape on the tape support passes over an edge portion of the roll paper sheet to attach a portion of the tape to the edge portion of the roll paper sheet with the adhesive coating of another portion of the tape being exposed.

3 Claims, 3 Drawing Sheets

ROLL PAPER AND TAPE DISPENSING EQUIPMENT

BACKGROUND OF THE INVENTION

This invention relates to roll paper dispensing equipment used in the painting industry, wherein a length of paper is stripped from a roll, the stripping action causing a roll(s) of masking tape to be played out along one or both edges thereof, the tape being adhesively attached along the edge so that half its width overhangs the edge of the paper, the selected length of paper being terminated by a cutter bar. The length of paper and attached tape is used to mask or protect portions of an object during painting.

An object of this invention is to provide an assembleable stool that can be packed in a minimum size carton.

A further object of this invention is to provide an assembleable stool to be used as a paper roll dispenser that can be assembled in a minimum number of steps.

An object of this invention is to provide a non-rotating bar attachment.

An object of this invention is to provide a drop-in paper roll bar.

SUMMARY OF THE INVENTION

Briefly, this invention provides a four-footed stool to be used as a drop-in paper roll dispenser with holddwon means. The stool provides a pair of side frames that are fixedly held in lateral spaced relationship by a step and two lateral members. The two lateral members, being non-rotatably attached, can provide mounting for other features as well as provide for easier assembly. The result is a single roll stool that can be shipped in a minimum size carton and correctly assembled with a minimum number of steps.

BRIEF DESCRIPTION OF THE DRAWINGS

The above and other objects and features of the invention will be apparent to those skilled in the art to which this invention pertains from the following detailed description and the drawings in which.

In the following detailed description and the drawings, like reference characters indicate like parts.

DESCRIPTION OF PRESENTLY PREFERRED EMBODIMENT

Figure 1:
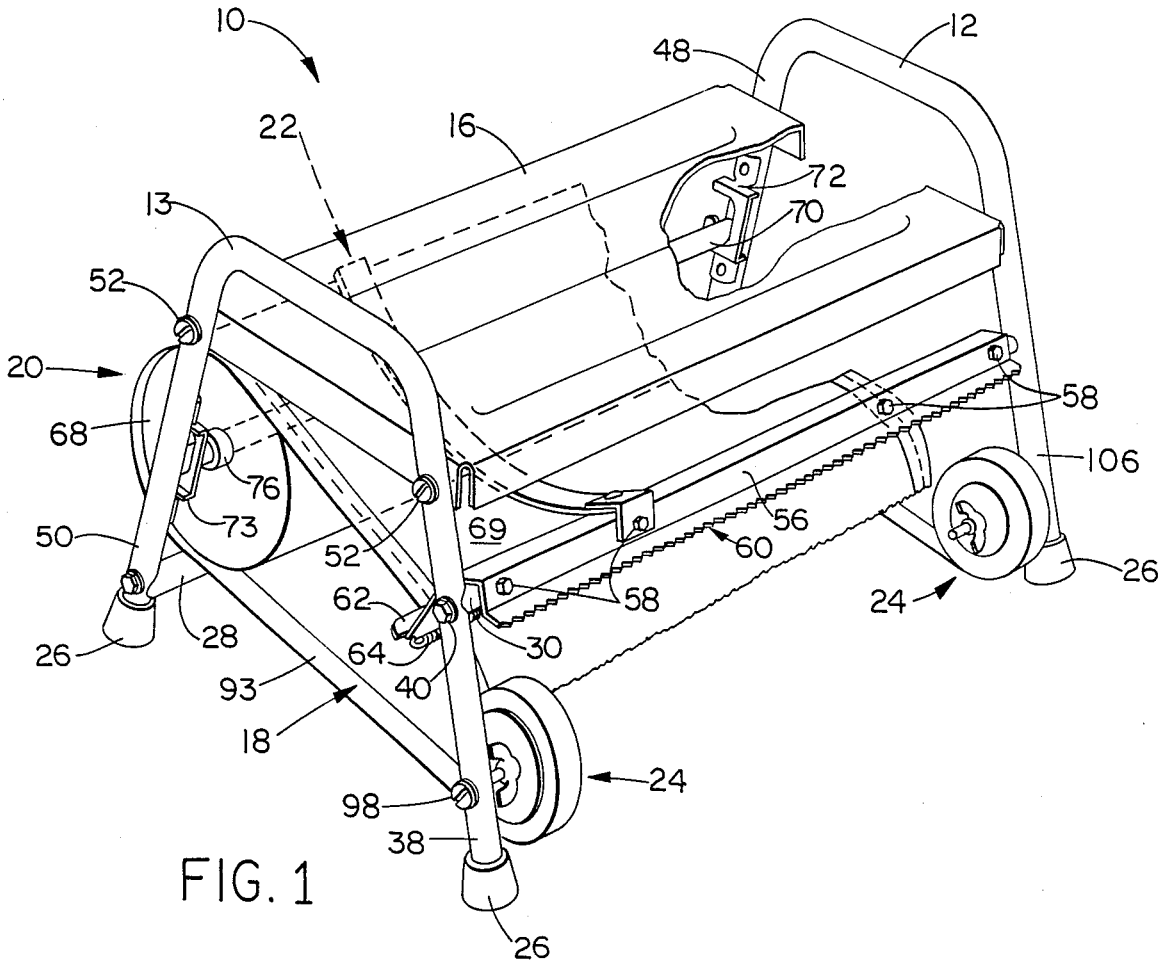
FIG. 1 is a perspective view of a single roll stool constructed in accordance with an embodiment of this invention showing a roll of paper and step partially cut away to clearly illustrate a paper bar drop-in bracket.

FIG. 1 shows a stool 10 built in accordance with a preferred embodiment of this invention. The stool 10 is comprised of a right side frame 12, a left side frame 13, a step 16, a cutter bar assembly 18, a paper roll assembly 20, a brake/holddown assembly 22, and two tape holder assemblies 24.

The right and left side frames 12 and 13 respectively are mirror images of each other, being formed of tubular metal into an approximate inverted "U" shape, the lower extremities thereof being fitted with resilient end caps 26 that function as feet. The legs of the right and left side frames 12 and 13 respectively are splayed forwardly and rearwardly for stability. The right and left frames 12 and 13 respectively are fixedly held in lateral spaced relationship by a rear bar 28, a forward bar 30, and the step 16.

Figure 5:
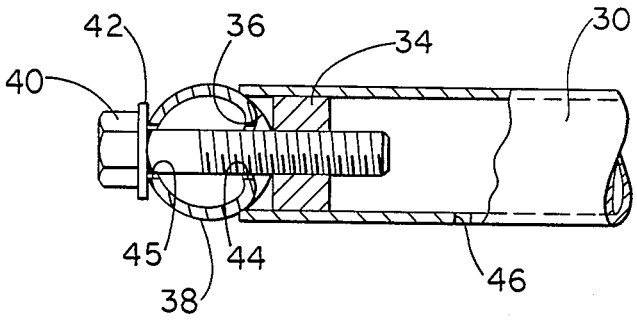
FIG. 5 is a fragmentary view of the attachment of a nonpivotal lateral member between the pair of side frames, portions of a lateral member being cut away for clarity.

The forward bar 30 incorporates a plug 34 that is rigidly affixed inside the left end thereof as is shown in FIG. 5. The left end of the forward bar 30 is scalloped to form a saddle 36 that cooperates with the outer cylindrical surface of a front left leg 38 of the left side frame 13. The saddle 36 prevents the forward bar 30 from rotating out of position, or conversely, it requires the forward bar 30 to take the correct position. Assembly becomes obvious since features on the bar will be either rightside up or upside down. A bolt 40, using a lock washer 43, passes through clearance holes 44 and 45 in the front left leg 38 to threadably mount into the plug 34. Note that the clearance holes 44 and 45 are punched through the front left leg 38 causing the metal wall about the entry hole 44 to cave inward. The wall about the exit hole 45 does not distort because the tube is supported by a die. The saddle 36 must be large enough to encompass the distorted area and properly seat against the tube. This leaves the undistorted side of the tube available for unobstructed access to the head of the bolt 40. If the clearance holes 44 and 45 had been reversed, then the lock washer 42 would have been distorted, rendering it useless.

A right end of the forward bar 30 is constructed and mounted in mirror image identity to the left end of the bar as just described. The front face of the forward bar 30 is provided with a set of four holes 46, only one of which is shown in FIG. 5.

The rear bar 28 is identical in construction and mounting to that of the forward bar 30 except that it does not have a set of four holes 46. It is fixedly attached between a right and a left rear leg 48 and 50 respectively just above the feet.

The upper portion of the right and left frames 12 and 13 respectively are fixedly held in lateral spaced relationship by the step 16. The step 16 is constructed of sheet metal with all four sides broken downwardly for rigidity. A set of four bolts 52 pass through clearance holes in the right and left side frames 12 and 13, through clearance holes in the side flanges of step 16, through a set of four lock washers (not shown), and threadably mount into a set of four nuts (also not shown).

The cutter bar assembly 18 incorporates a cutter plate 56 and the brake/holddown assembly 22. The cutter plate 56 is fixedly attached to the front side of the forward bar 30 by a set of screws 58 that pass through clearance holes in the vertical face thereof to threadably mount into the set of four holes 46. The cutter plate 56 extends downwardly therefrom to approximately the level of the bottom of the forward bar 30 where it is broken outwardly to a row of teeth 60. The cutter plate 56 also extends upwardly from the set of four screws 58 to pass over the forward bar 30 and then downwardly and inwardly to a lip 62. A spring 64 is hooked into edge slots at the vertex of the lip 62 and lies adjacent thereto from one side of the cutter plate 56 to the other.

Figure 7:
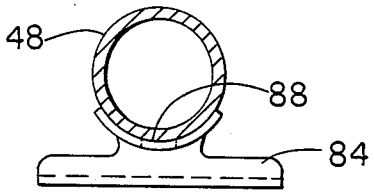
FIG. 7 is a plan view of the drop-in bracket taken in the direction of arrows 7—7 of FIG. 6.
Figure 6:
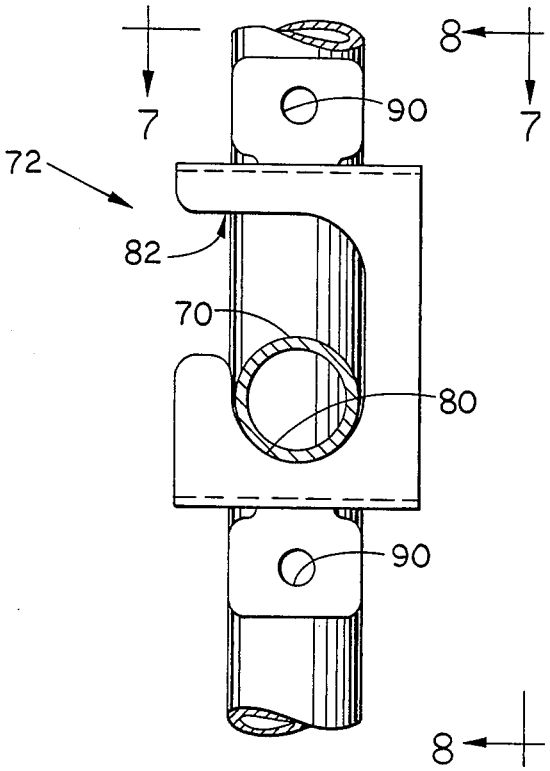
FIG. 6 is a side elevational view of a paper roll bar drop-in bracket of the stool.
Figure 8:
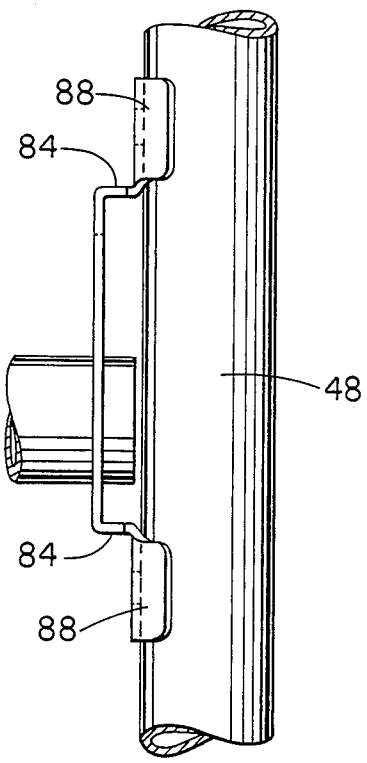
FIG. 8 is a front elevational view of the drop-in bracket taken in the direction of arrows 8—8 of FIG. 6.

The paper roll assembly 20 incorporates a bar 70, a right hand bracket 72, a left hand bracket 73, a pair of stop collar assemblies 76, and a roll of paper 68. The right hand bracket 72 is best shown is FIGS. 6 to 8. Stamped from sheet metal, the right hand bracket 72 incorporates a cradle 80 and an access passage 82 for the bar 70 upon which the roll of paper 68 is rotatably mounted. As shown in FIG. 6, the cradle 80 of the right hand bracket 72 is set inwardly from the right rear leg 48 by a pair of horizontally disposed flanges 84. Each flange 84 incorporates a mounting shoe 88 that in turn incorporates a hole 90 through the middle thereof. The right hand bracket 72 is rigidly affixed to the inboard surface of the right rear leg 48 at a middle height between the rear bar 28 and the step 16 by the application of plug welds in holes 90. Holes 90 could accommodate mechanical fasteners if desired.

The left hand bracket 73 is a mirror image duplicate of the right hand bracket 72 just described and is rigidly affixed to the left rear leg 50 directly opposite bracket 72. The roll or paper 68 is wound upon its own paper core that is in turn rotatably placed upon the bar 70. The pair of stop collar asemblies 76 are fixedly attached in place upon the rod 70 to hold the roll of paper 68 thereon. The brake/holddown assembly 22 is raised and the bar 70 with the roll of paper 68 is entered into access passages 82 and downwardly into cradles 80 of the right and left hand brackets 72 and 73 respectively. The bar 70 is longer than the lateral distance between the cradles 80, but sufficiently short of the lateral distance between the right and left rear legs 48 and 50 respectively to permit clear entry and exit therefrom. The weight of the roll of paper 68 is sufficient to keep the bar 70 in place in the cradles 80 unitl the stool is upset. The brake/holddown assembly 22 is intended to keep the roll of paper 68 in place if the stool is upset.

Figure 2:
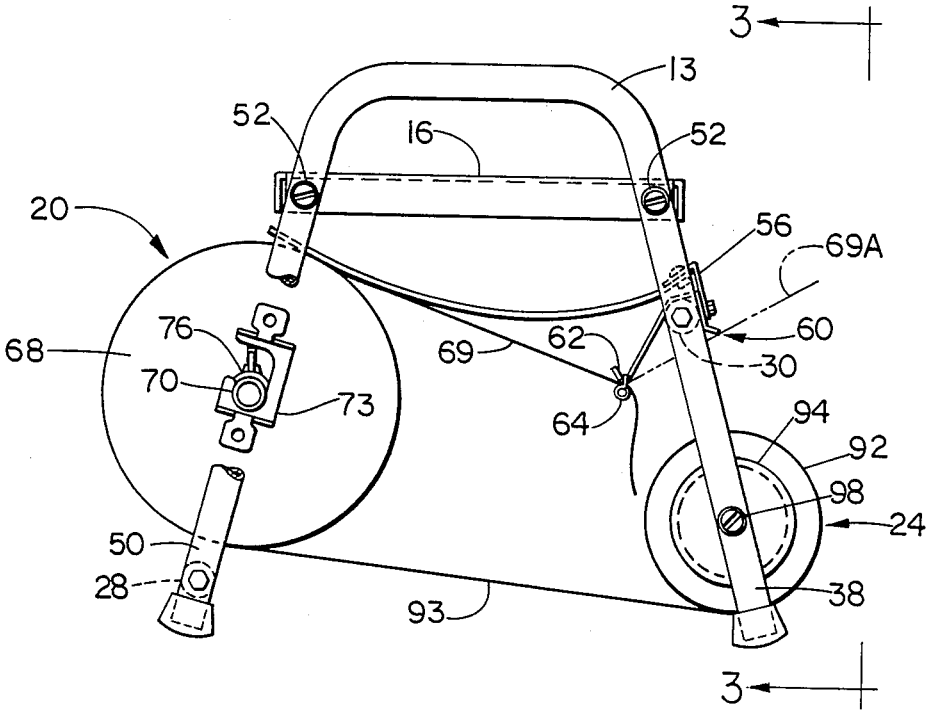
FIG. 2 is a side elevational view of the stool partly broken away to show details of structure.

Referring now to FIG. 2, a continuous sheet of paper 69 is fed off the top of the clockwise rotating roll of paper 68 and passes between the spring 64 and the lip 62 of the cutter bar assembly 18. The roll of paper 68 is prevented from free feeding by means of the brake/-holddown assembly 22 that is fixedly attached to the forward bar 30 by one of the screws of the set of screws 58.

Figure 3:
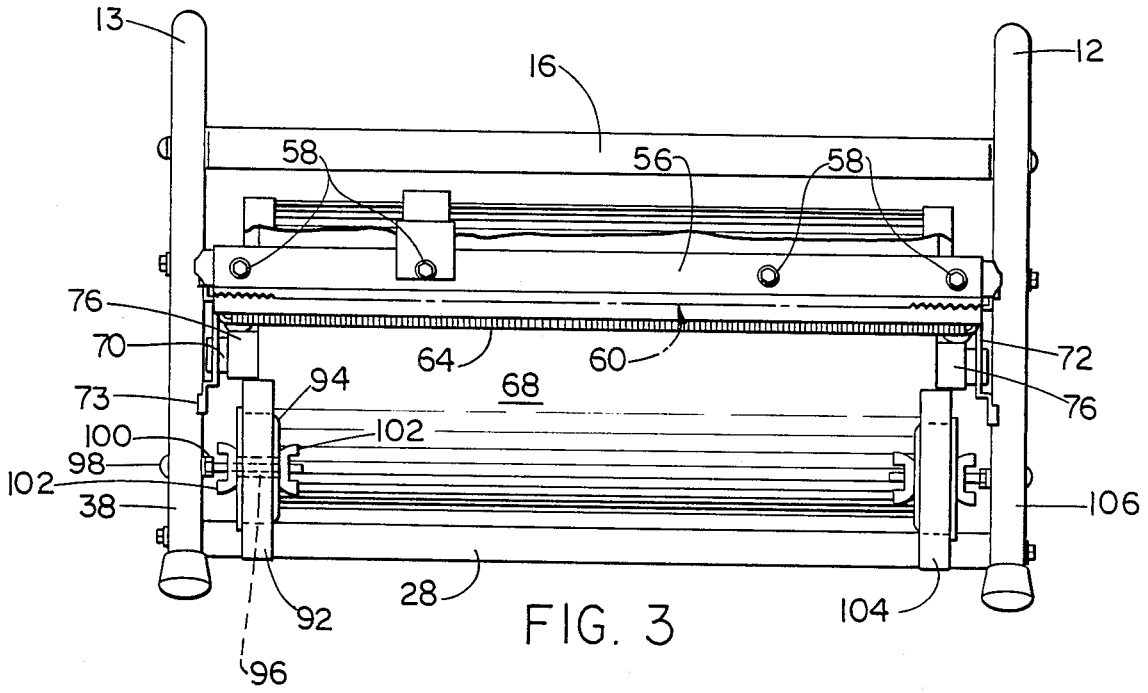
FIG. 3 is a front elevational view of the stool taken in the direction of the arrows 3—3 of FIG. 2.
Figure 4:
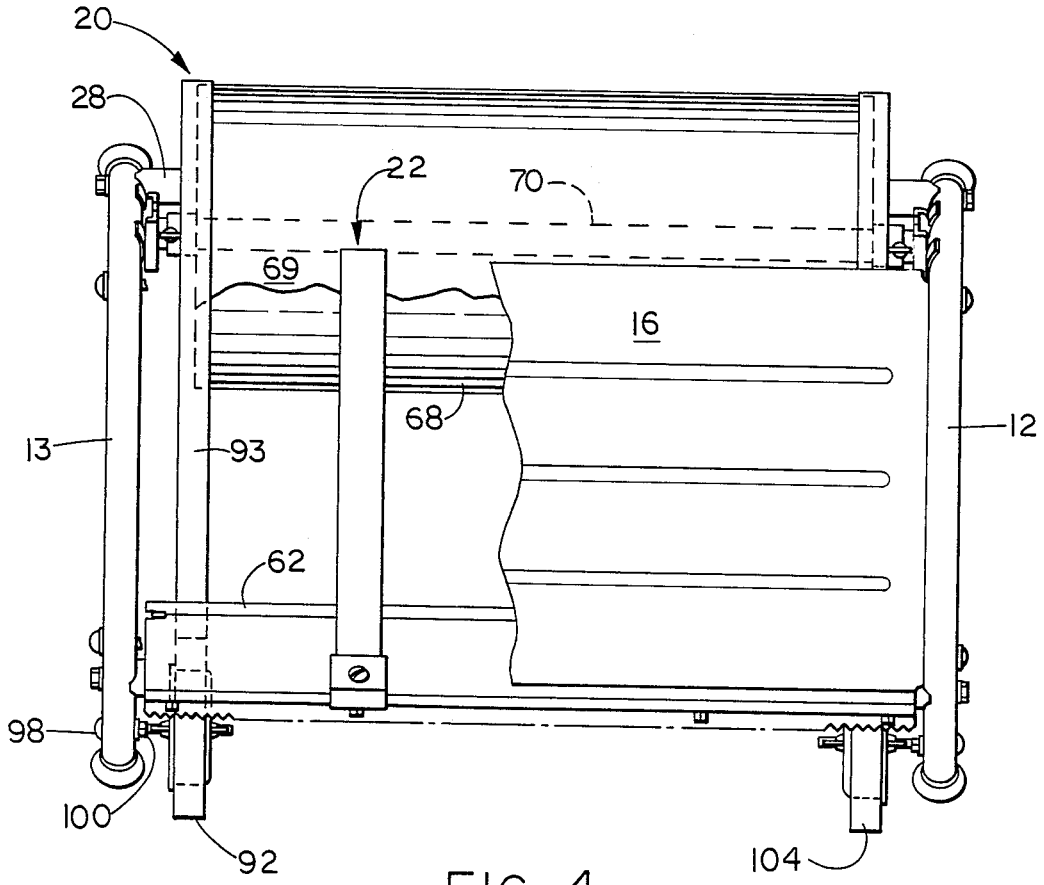
FIG. 4 is a plan view of the single roll stool with a step thereof partially cut away.

Referring to FIG. 3, a roll of tape 92 is frictionally placed upon a hub 94 that is in turn rotatably mounted on a sleeve 96. The sleeve 96 is clampedly mounted upon a bolt 98 that passes through clearance holes punched through the front left leg 38 of the left side frame 13 somewhat below the level of the bar 70 to prevent interference with the cutter bar assembly 18. The bolt 98 is fixedly attached through the front left leg 38 by a nut and washer 100. The sleeve 96 is repositioned by means of a pair of wing nuts 102 so that the centerline of the roll of tape 92 can be aligned with the edge of the roll of paper 68.

Referring to FIG. 2, the roll of tape 92 is fed from the bottom thereof with clockwise rotation. Tape 93 passes to the underside of the roll of paper 68 to which it adheres. The tape 93 has one face, which is fed against the continuous sheet of paper 69, contact with pressure sensitive adhesive. As the continuous sheet of paper 69 is pulled between the spring 64 and the lip 62, the tape 93 continues to feed onto the roll of paper 68. After the user has sufficient length, the taped paper is pulled upwardly to a position indicated by 69A and to one side or the other to effect a cutoff against the row of teeth 60.

Another roll of tape 104 is identically mounted in mirror fashion to a right front leg 106 of the right side frame 12. Obviously the continuous sheet of paper 69 can be taped on either side or both sides.

The single roll masking paper stool 10 comes in a minimum size shipping carton. The cutter bar assembly 18, including brake/holddwon assembly 22, would be factory assembled. Subsequently, what the end user has to do is:

(a) Bolt the cutter bar assembly 18, the rear bar 28, and the step 16 between the right and left side frames 12 and 13, respectively. A wrench and screwdriver are required. Because of the saddle 36, proper positioning of the cutter bar assembly 18 is assured.

(b) Inserted two bolts 98 of the rolls of tape 92 and 104 through the left and right front legs 38 and 106, respectively, and secure with nuts and washers 100. The pair of wing nuts 102, the sleeve 96 and the hub 92 do not require tools.

The single roll masking paper stool 10 may be assembled with only a screwdriver and a wrench.

The single roll masking paper stool 10 illustrated in the drawings and described above is subject to structural modification without departing from the spirit and scope of the appended claims.

Having described my invention, what I claim as new and desire to secure by letters patent is:

1. A dispensing stand for supporting a roll of paper and a roll of tape having an adhesive coating on one face thereof which comprises four upright leg members, opposed roll supports on opposed ones of the leg members, roll of paper support means mountable in said roll supports to support said roll of paper, a tape support on another of the leg members, tape from the roll of tape on the tape support passing over an edge portion of the roll of paper to attach a first adhesive coated portion of the tape to the edge portion of the outer convolution of the roll of paper with another portion of the adhesive coated portion of the tape being exposed, a plate spanning leg members spaced from the opposed ones of the leg members, a paper web with attached tape extending from the roll of paper and passing adjacent the plate, tension spring means carried by the plate and extending crosswise of the paper web with attached tape and urging the paper web and the tape together and toward the plate to cause firm adherence of the first portion of the tape to the paper web, and second spring means mounted on the plate and engageable with an outer layer of the roll of paper to brake movement of the roll of paper supported on said roll of paper support means to preclude overrunning of the roll of paper and to retainingly urge the roll of paper support means in supported relation to said roll supports.

2. A stand as in claim 1 wherein the adhesive coated face of tape extending between a roll of tape on a tape support and the roll of paper and the opposed facing exposed adhesive coating of tape attached to the paper web extending from the roll of paper to the plate and tension spring means carried by said plate are maintained in tension by cooperation of the second spring means with the surface of the roll of paper and the paper web and cooperation of the plate and tension spring means with the paper web and the attached tape at a location adjacent the end of the web remote from the roll of paper.

3. A stand as in claim 1 in which there is a second tape support for tape having a pressure sensitive adhesive coating on one face thereof on a further one of the upright leg members, tape from the second tape support passes over a second edge portion of the roll paper sheet to attach a portion of the tape from the second tape support to the second edge portion of the roll paper sheet with another portion of the tape from the second tape support being exposed and the tension spring means urges the roll paper sheet and the tape from the second tape support together.

* * * * *